US009346476B2

(12) United States Patent
Dargy et al.

(10) Patent No.: US 9,346,476 B2
(45) Date of Patent: May 24, 2016

(54) TRACK-DATA VERIFICATION

(71) Applicant: Herzog Technologies, Inc., St. Joseph, MO (US)

(72) Inventors: Glen Dargy, Cedar Rapids, IA (US); Lee Olson, Cedar Rapids, IA (US); Matt Schouten, Cedar Rapids, IA (US); Gregory G. Hackbarth, Colleyville, TX (US)

(73) Assignee: HERZOG TECHNOLOGIES, INC., St. Joseph, MO (US)

( * ) Notice: Subject to any disclaimer, the term of this patent is extended or adjusted under 35 U.S.C. 154(b) by 119 days.

(21) Appl. No.: 14/491,390

(22) Filed: Sep. 19, 2014

(65) Prior Publication Data

US 2015/0094885 A1 Apr. 2, 2015

Related U.S. Application Data

(60) Provisional application No. 61/883,486, filed on Sep. 27, 2013.

(51) Int. Cl.
*B61L 23/04* (2006.01)
*B61L 25/02* (2006.01)

(52) U.S. Cl.
CPC ..... *B61L 23/047* (2013.01); *B61L 23/048* (2013.01); *B61L 25/025* (2013.01); *B61L 2205/00* (2013.01)

(58) Field of Classification Search
CPC ... B61L 23/047; B61L 23/048; B61L 25/025; B61L 2205/00
See application file for complete search history.

(56) References Cited

U.S. PATENT DOCUMENTS 6,434,452 B1 8/2002 Gray
7,755,660 B2 * 7/2010 Nejikovsky ..... B61K 9/08 348/135

(Continued)

OTHER PUBLICATIONS

Barber et al., "Geometric validation of a ground-based mobile laser scanning system." ISPRS Journal of Photogrammetry and Remote Sensing, vol. 63 No. 1, Jan. 2008, pp. 128-141.*

(Continued)

*Primary Examiner* — Todd Melton
(74) *Attorney, Agent, or Firm* — Erickson Kernell Derusseau & Kleypas, LLC

(57) ABSTRACT

A track-data verification vehicle and method for verifying positive train control (PTC) track data. The vehicle includes a 360° camera and a precision positioning system co-located on a vertical axis on the vehicle. The 360° camera provides a video image with indicators that are useable to align an asset with the positioning system. A second video camera is positioned interior to the vehicle to capture an image of a monitor associated with a train management control (TMC) unit and of operator inputs to the TMC unit; the TMC unit executes a PTC track-data verification application. The process of verifying asset locations is thus recorded and can be reviewed and approved by a Federal Railroad Administration representative without requiring the representative to be physically present within the vehicle during track-data verification.

20 Claims, 7 Drawing Sheets

(56) References Cited

U.S. PATENT DOCUMENTS

| | | | |
|---|---|---|---|
| 7,805,227 | B2 | 9/2010 | Welles et al. |
| 8,073,581 | B2 | 12/2011 | Morris et al. |
| 8,150,568 | B1 | 4/2012 | Gray |
| 8,452,467 | B2 | 5/2013 | Kumar |
| 8,538,609 | B2 | 9/2013 | Kumar |
| 8,712,610 | B2 | 4/2014 | Kumar |
| 2009/0037039 | A1 | 2/2009 | Yu et al. |
| 2009/0276108 | A1 | 11/2009 | Kumar et al. |
| 2012/0179309 | A1 | 7/2012 | Wilson et al. |
| 2012/0274772 | A1* | 11/2012 | Fosburgh ..... B61K 9/08 348/149 |

OTHER PUBLICATIONS

Redding et al., "Vision-based target localization from a fixed-wing miniature air vehicle," Proceedings of the 2006 American Control Conference, Jun. 2006, pp. 2862-2867.*

* cited by examiner

TRACK-DATA VERIFICATION

CROSS-REFERENCE TO RELATED APPLICATIONS

This application claims priority to U.S. Provisional Patent Application No. 61/883,486 filed Sep. 27, 2013 and titled TRACK-DATA VERIFICATION, the disclosure of which is hereby incorporated herein in its entirety by reference.

BACKGROUND

The Rail Safety Improvement Act of 2008, as enacted by the U.S. Congress, requires all Class I railroads and passenger rail operators to implement a mandatory Positive Train Control (PTC) collision avoidance system. PTC introduces continuous global positioning system (GPS) based location and speed tracking, with sophisticated on-board wireless technology that enables enforcement of vehicle movement in a rail system from a centralized control center. PTC utilizes a mapping of the tracks in a rail system and of assets located along the tracks, such as rail crossings, signals, mile markers, and the like. The mapping information is configured into track data files or subdivision files for each segment of track in the rail system.

The PTC track data must be verified prior to its use. The verification process requires that every feature in the PTC onboard track data is verified to have an accurate position to within 2.2 meters of the position reported by a precision GPS unit.

Current processes for track-data verification require a vehicle to be driven along a rail system to each of a plurality of assets whose GPS location is to be verified. The vehicle is moved along the tracks to align a precision GPS unit mounted on the vehicle or towed therebehind alongside the asset, e.g. the GPS unit is positioned such that a line drawn between the GPS unit and the asset is generally perpendicular to the length of the tracks. This alignment is typically visually aligned or "eyeballed" by an operator traveling in the vehicle.

Depending on the location of the GPS unit relative to the operator, the alignment may be verified by aligning the asset with a window of the vehicle or a mark placed on or adjacent to the window. Or the operator may exit the vehicle to view the asset and GPS unit and to instruct a driver of the vehicle to move the vehicle into proper alignment, such as when the GPS unit is mounted on a trailer towed behind the vehicle. Such as verification system is time consuming, prone to operator error, and may expose the operator to dangerous conditions.

Additionally, the current process requires a representative of the Federal Railroad Administration (FRA) to witness the validation. This can create scheduling conflicts or difficulties and is an inefficient use of manpower resources.

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed Description section below. This summary is not intended to identify key features or essential features of the claimed subject matter, nor is it intended to be used as an aid in isolation to determine the scope of the claimed subject matter. In brief, this disclosure describes, among other things, a track-data verification vehicle and method for generating a video-based record of track-verification activities.

The track-data verification vehicle is configured for travel on the tracks of a rail system. The vehicle includes a 360° video camera and a precision GPS unit mounted on top of the vehicle. A positive train control (PTC) track data verification system is disposed interior to the vehicle. A second video camera is positioned within the vehicle to capture a view of a monitor associated with the PTC track data verification system and of user interactions with a set of input controls.

A video monitor is also located within the vehicle and displays a 360° video image captured by the 360° video camera. The video image includes a pair of indicators that depict locations in the video image at which objects depicted therein are physically in a desired alignment with the GPS unit.

In use, the track-data verification vehicle is driven along the tracks to the location of an asset, the position of which is to be verified. A 360° video image captured by the 360° video camera is displayed on the video monitor within the vehicle. Using the indicators included in the 360° video image, the asset is aligned with the GPS unit, e.g. the representation of the asset in the video image is aligned with the respective indicator. The position of the asset relative to the tracks is then recorded by providing an input to a keypad associated with the PTC track data verification system.

Simultaneously with positioning the vehicle and aligning the asset with the GPS unit, the second video camera inside the vehicle captures an image of the display monitor associated with the PTC track data verification system and of the keypad associated therewith. The second video camera thus also captures the operator's inputs to the keypad.

The data captured by the PTC track data verification system including the GPS data, the 360° video, and the video captured by the second video camera are synchronized to provide correspondence therebetween. Thus, the data elements can be reviewed at a later date and can be referenced relative to one another. In one embodiment, a composite video is generated for reviewing the data verification process. The composite video includes the 360° video superimposed over a portion of the video image captured by the second video camera to enable an operator to view both videos simultaneously. As such, verification of the track-data can be reviewed and approved by an FRA representative when it is convenient for the representative and without the representative being required to ride along in the track-data verification vehicle.

DESCRIPTION OF THE DRAWINGS

Illustrative embodiments of the invention are described in detail below with reference to the attached drawing figures, and wherein.

DETAILED DESCRIPTION

Figure 1:
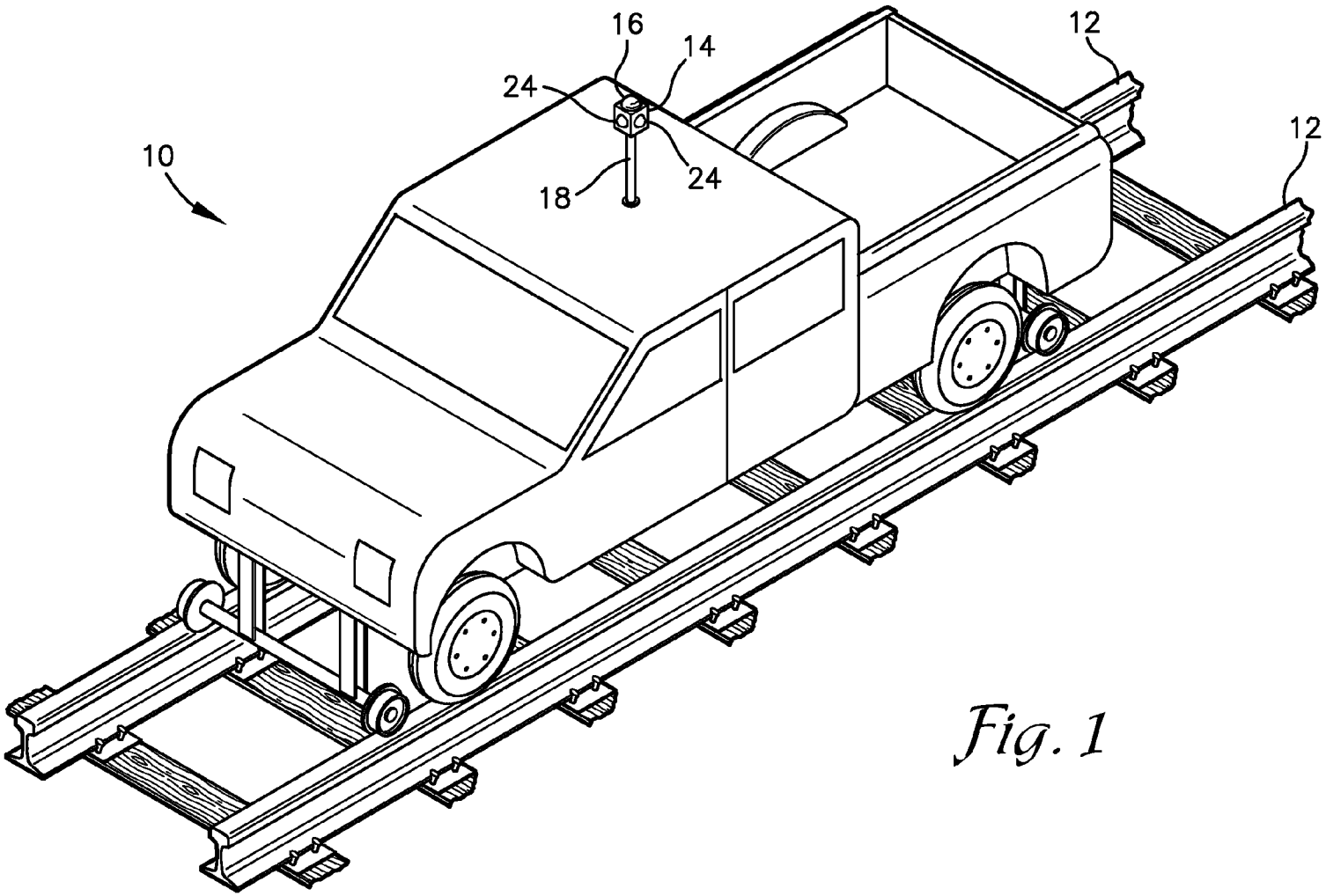
FIG. 1 is a perspective view of a track-data verification vehicle depicted in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

With initial reference to FIGS. 1-5, a track-data verification vehicle 10 is described in accordance with an embodiment of the invention. As depicted herein, the vehicle 10 comprises a standard light-duty pickup truck configured for travel on the tracks or rails 12 of a rail system; such vehicles are commonly referred to as hirail or hyrail vehicles in reference to their adaption for travel on both highways and rails. However it is understood that the vehicle 10 can comprise any vehicle adapted or configured for travel on the rails 12 including, for example, heavy-duty trucks, maintenance vehicles, rail cars, hand cars, locomotives, remote-controlled vehicles, or the like. Further, the vehicle 10 is depicted with a crew-cab or five-seat interior configuration, but other configurations can be employed. One or more of the components of the track-data verification vehicle 10 might also be disposed on a trailer or rail car that is pulled or pushed by the vehicle 10. All such configurations are within the scope of embodiments of the invention described herein.

An external camera 14 and a positioning system 16 are mounted on top of the vehicle 10. The external camera 14 is disposed on a support post 18 to provide sufficient height above the vehicle 10 so that the vehicle 10 does not overly obstruct the external camera's view of the ground or objects on or near the ground, as shown best by viewing regions or viewing cones 20 and 22 depicted in FIG. 4. The positioning system 16 is mounted on top of the external camera 14. The positioning system 16 may alternatively be mounted vertically below or further above the external camera 14 or laterally adjacent thereto. For example, the positioning system 16 may be mounted between left and right facing sensors of the external camera 14 in a single horizontal plane. But, it is preferable that the external camera 14 and positioning system 16 be co-located along a vertical axis to ensure positional alignment of the camera view with a geographic position indicated by the positioning system 16.

Figure 5:
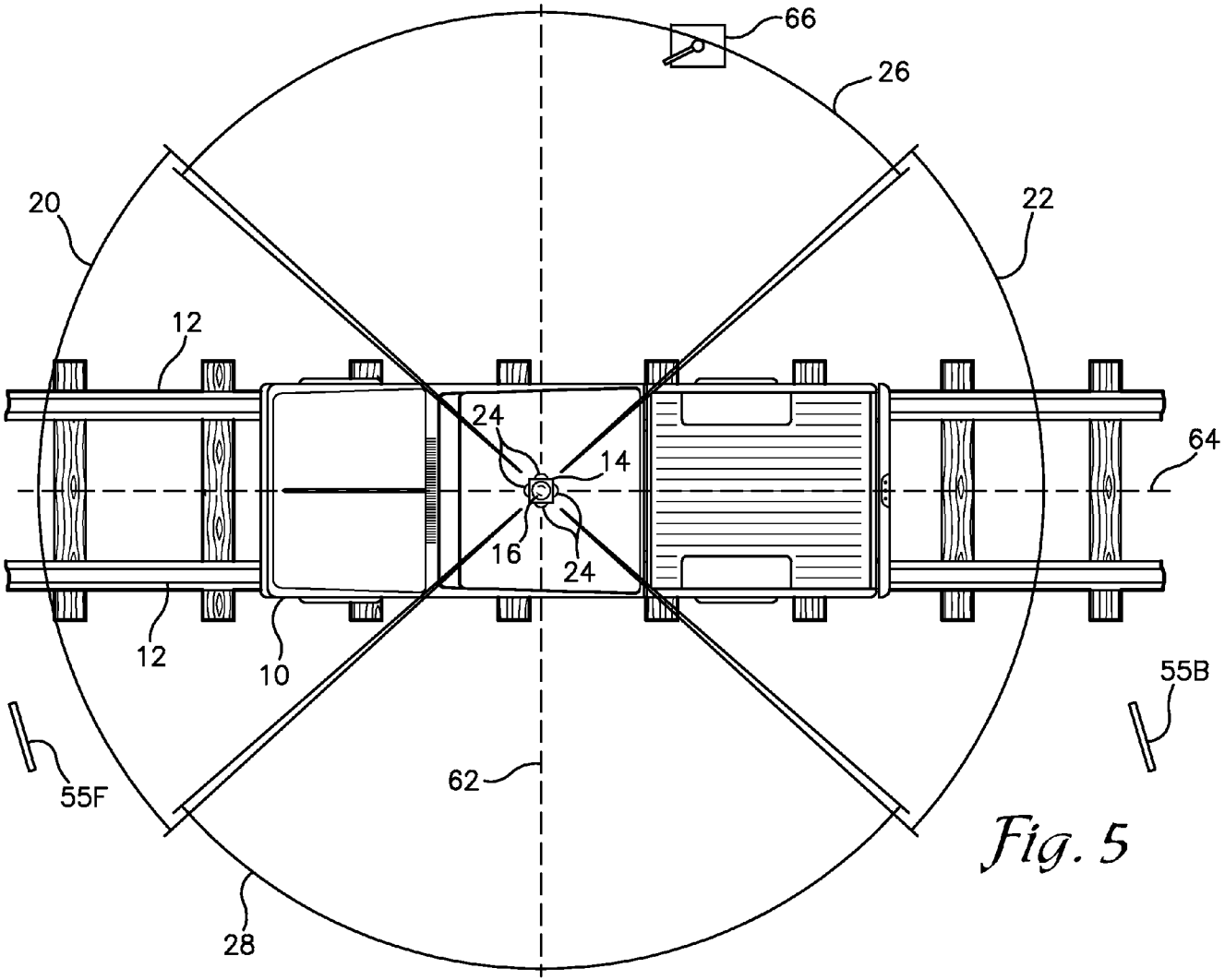
FIG. 5 is a top plan view of the track-data verification vehicle of FIG. 1 depicting view regions of each of a plurality of sensors of a 360° camera mounted above the vehicle and railroad assets disposed alongside the tracks.
Figure 6:
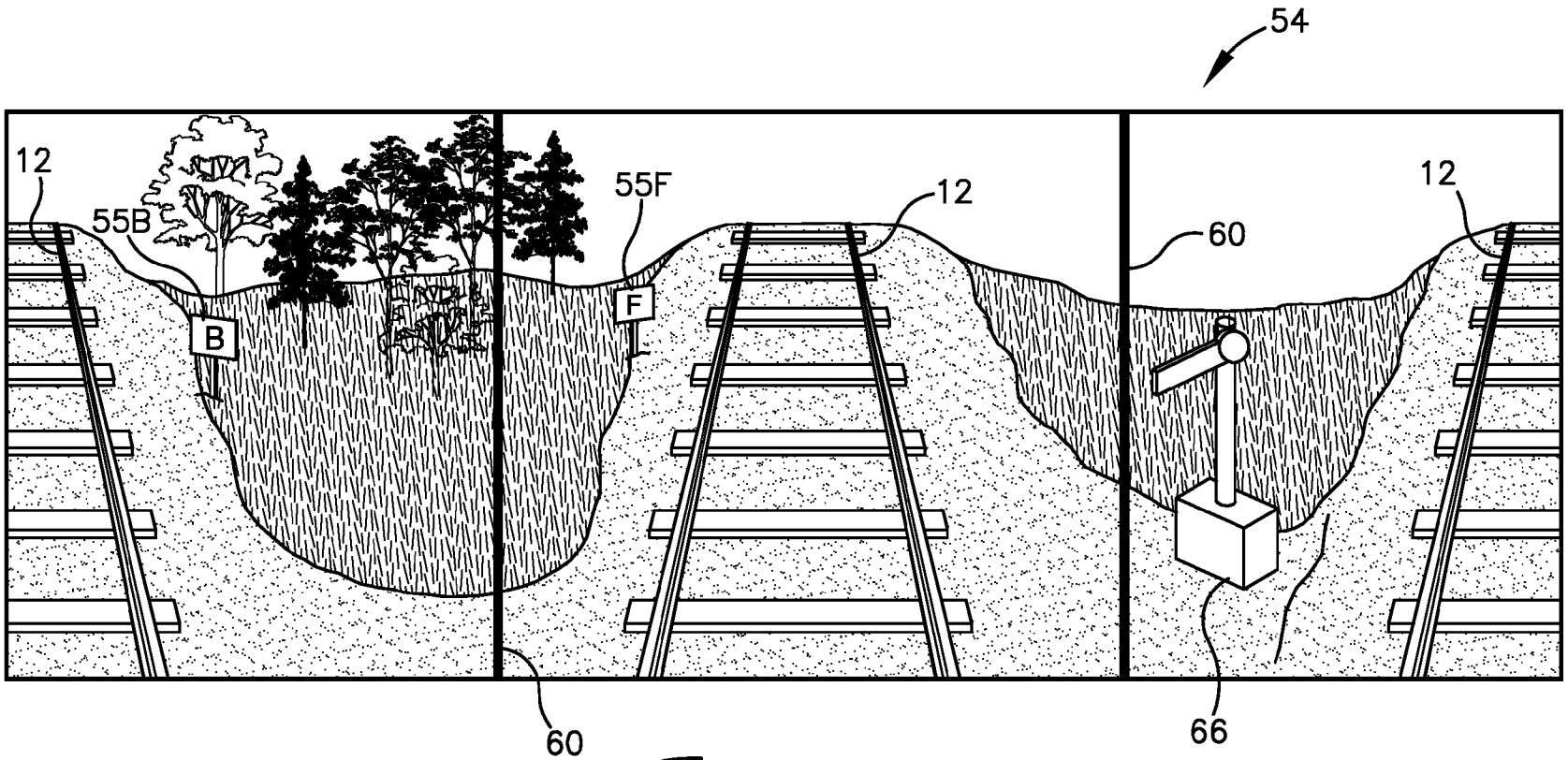
FIG. 6 is an exemplary illustration of a composite view captured by the 360° camera depicted in FIG. 5.

The external camera 14 preferably comprises a 360° camera configured to generate an image that spans 360° horizontally around the external camera 14 and/or the vehicle 10. The external camera 14 includes a plurality of image sensors 24 or an array of cameras that each capture an image from a respective, overlapping viewing region 20, 22, 26, 28 (see FIG. 5). The images can then be combined to produce a single or composite 360° image, as depicted in FIG. 6. The external camera 14 is preferably configured to capture video but may also be configured to capture still frame images. Other forms and configurations of cameras and combinations thereof that capture 360° views or another viewing angle may be employed in embodiments of the invention without departing from the scope described herein.

The positioning system 16 is preferably a precision global positioning system (GPS) unit configured to provide centimeter-level positional accuracy however other more or less precise units may be employed. Other positioning system technologies including the GLONASS system operated by the Russian Aerospace Defense Forces, the Galileo system provided by the European Union and European Space Agency, or the Long Range Navigation (LORAN) hyperbolic radio navigation system developed by the United States, among other satellite-based and non-satellite-based systems can be employed instead of or in addition to GPS. The complete positioning system 16 may be mounted on top of the external camera 14 or only a receiver or antenna portion thereof might be mounted on the external camera 14 while the remainder of the unit 16 is disposed within the vehicle 10 or integrated into a control unit 50 as discussed below. The position reported by the positioning system 16 is the position of the portion of the positioning system 16 that is co-located with the camera 14. Alternatively, the receiver or antenna portion of the positioning system unit 16 may be provided in association with the vehicle 10 with a known offset from the external camera 14. The actual position of the external camera 14 and/or asset to be verified can thus be calculated based on the known offset.

Figure 2:
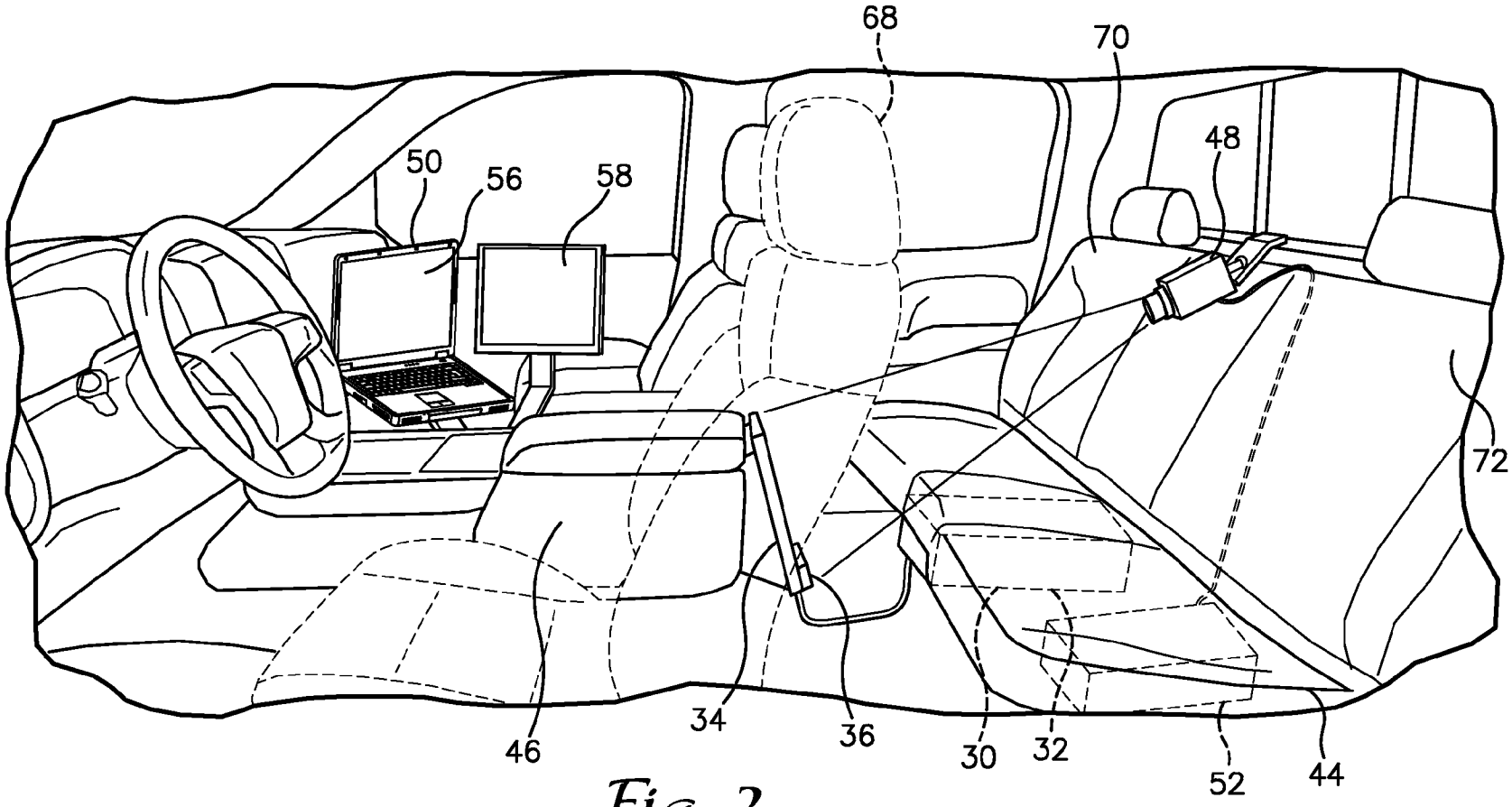
FIG. 2 is side view of the interior of the track-data verification vehicle of FIG. 1 depicted in accordance with an embodiment of the invention.
Figure 3:
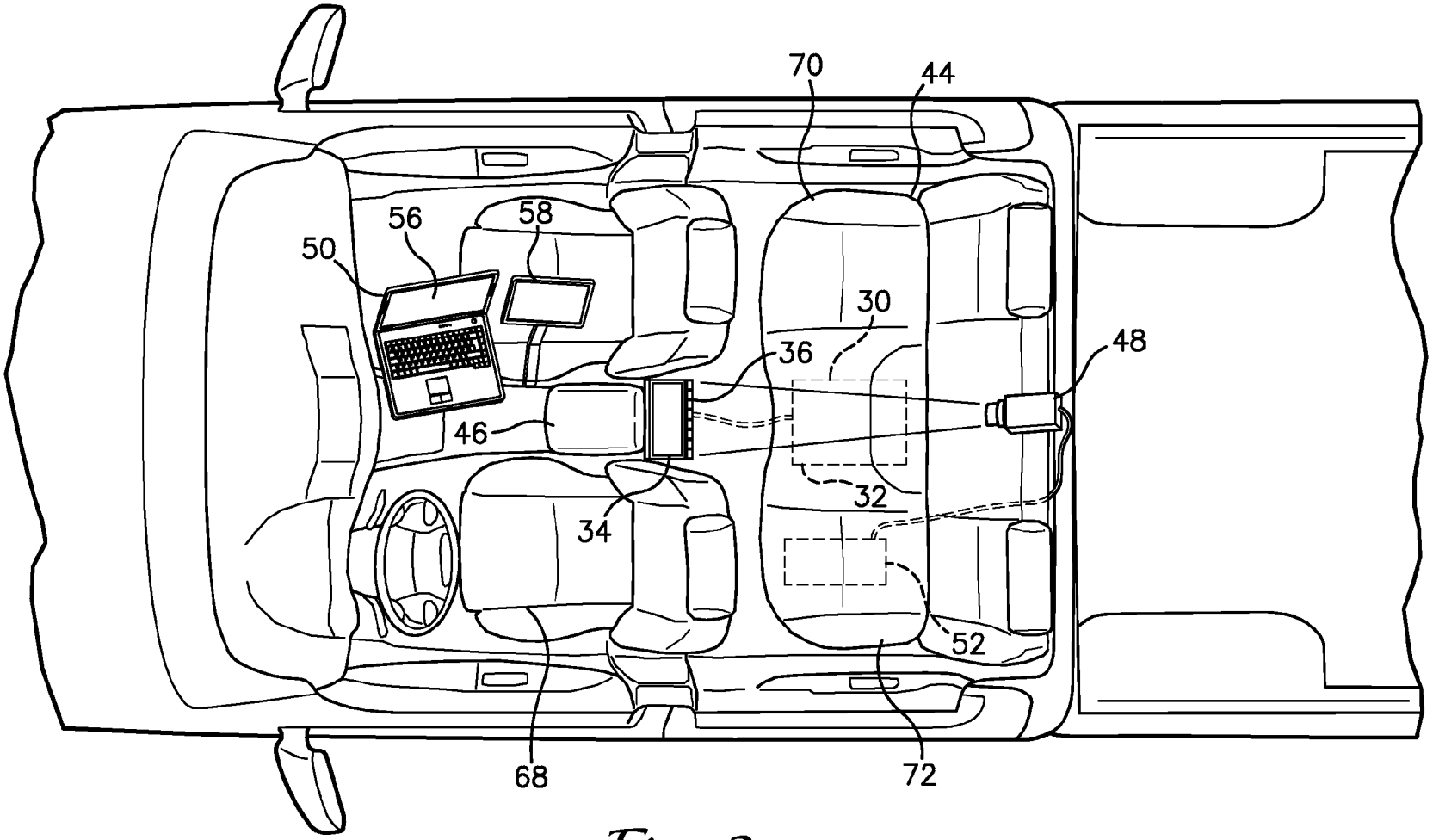
FIG. 3 is a top plan view of the interior of the track-data verification vehicle of FIG. 1.
Figure 4:
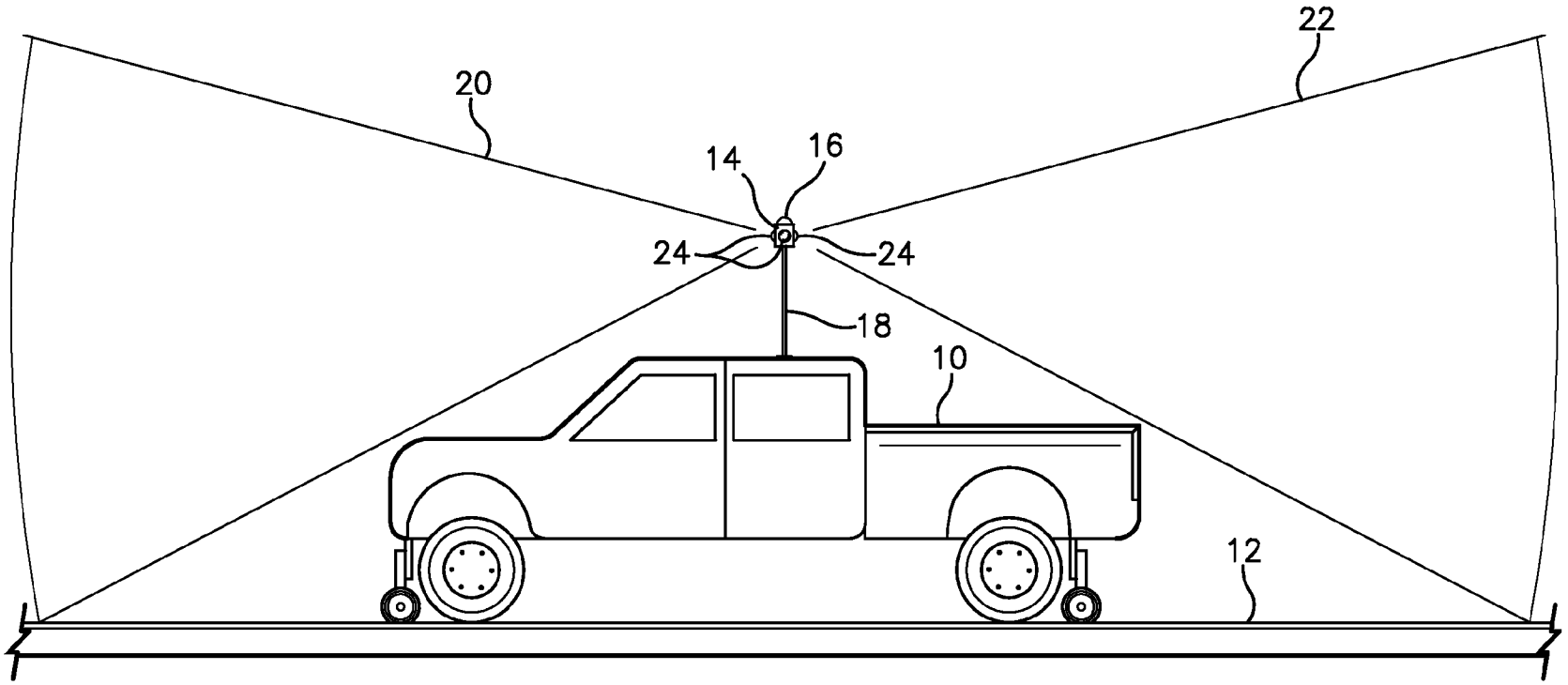
FIG. 4 is a side elevational view of the track-data verification vehicle of FIG. 1 depicting view regions of forward and rearward facing sensors of a 360° camera mounted above the vehicle.
Figure 7:
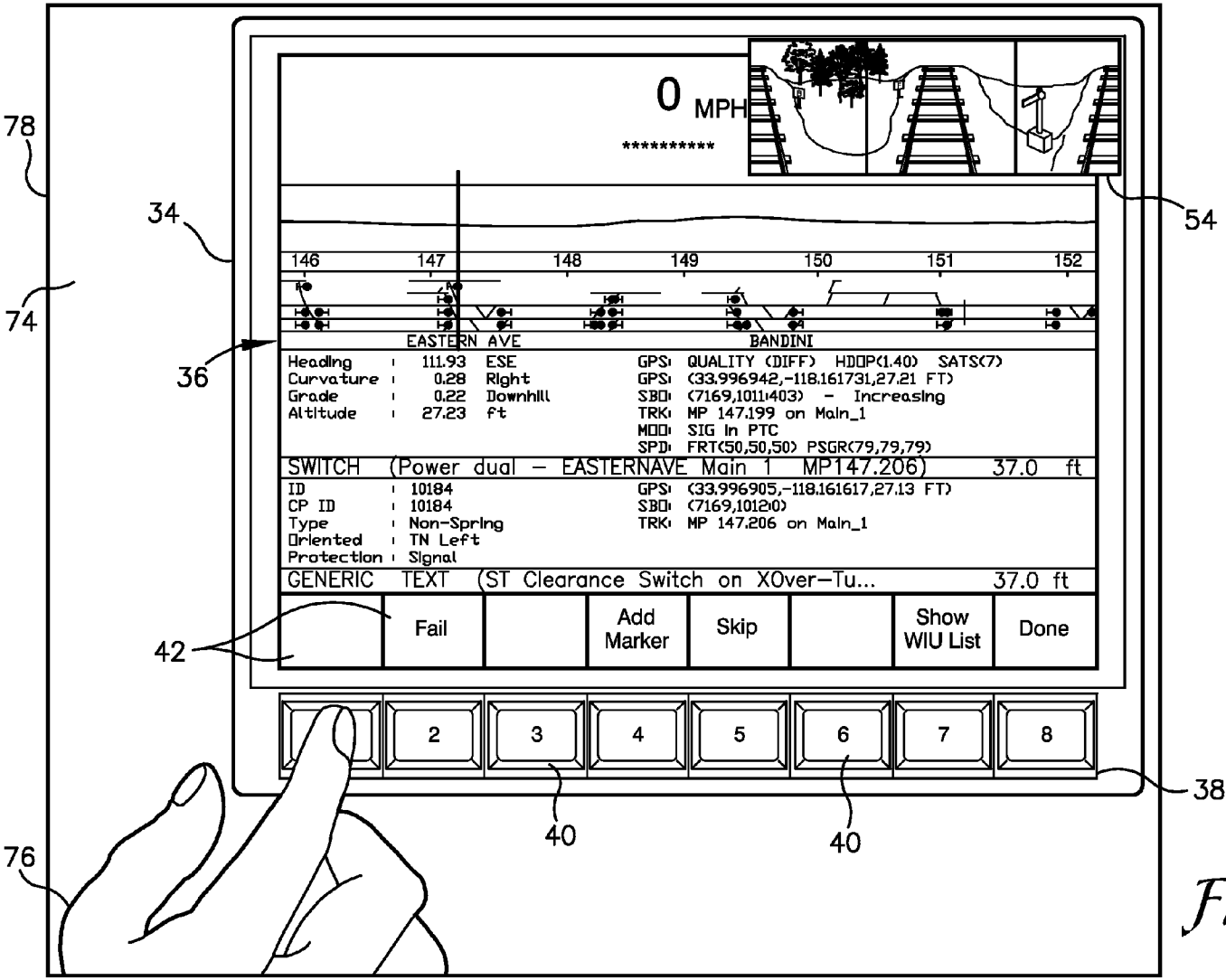
FIG. 7 is an exemplary illustration of a composite video record generated by a track-data verification vehicle depicted in accordance with an embodiment of the invention.

With reference now to FIGS. 2 and 3, a positive train control (PTC) data-verification unit 30 is disposed in the interior of the vehicle 10. The PTC data-verification unit 30 includes a computing unit 32 and a display device 34 and is communicatively coupled to the positioning system 16 for obtaining positional data therefrom. The computing unit 32 may comprise a train management control (TMC) unit that executes a PTC data verification application, such as for example, a train management controller provided by the WABTEC Corporation of Wilmerding, Pa. The display device 34 is communicatively coupled to the computing unit 32 and displays a PTC data verification screen 36 for viewing by an operator in the vehicle 10, as best depicted in FIG. 7.

The PTC data-verification unit 30 also includes an input device or keypad 38 disposed in close proximity to the display device 34. The keypad 38 includes a plurality of buttons 40 that are associated with respective soft-key fields 42 displayed in the PTC data verification screen 36. In an embodiment, the keypad 38 is mounted or located separately from the display device 34 and comprises another form of input device, such as for example, a microphone for receiving voice commands or notes, a mouse, a track-pad, or the like. As depicted in FIGS. 2-3, the computing unit 32 is disposed under a rear seat 44 of the vehicle 10 and the display device 34 is mounted at an upward facing angle behind a center console 46 of the vehicle 10, however, other configurations may be employed in embodiments of the invention.

An input-capture system comprising an internal camera 48 is mounted in the interior of the vehicle 10 and positioned to capture an image of the display device 34 and the keypad 38. As depicted in FIGS. 2-3, the internal camera 48 is mounted along a rear wall 50 of the interior of the vehicle 10 but it might be mounted in any desired location that provides a suitable view of the display device 34 and keypad 38. In one embodiment, inputs to the keypad 38 are visibly depicted by the screen 36; the keypad 38 may thus not be included within the view of the internal camera 48. In such an embodiment, the internal camera 48 might be replaced with a screen capture application executing on the computing unit 32. The internal camera 48 is an available video camera suitable for capturing video of the screen 36 and the keypad 38 but the internal camera 48 may comprise any available video or still camera technology without departing from the scope of embodiments of the invention described herein.

In another embodiment, the input-capture system comprises an application executing on a computing device, such as a control unit 50 (described below) that interfaces with the PTC data-verification unit 30 to record the provision of inputs thereto. The input-capture system may also capture a representation of a display presented by the PTC data-verification unit 30 or data presented thereon concurrently with provision of the inputs.

The control unit 50, such as a laptop computer, or other computing device, is provided in the vehicle 10. The control unit 50 is communicatively coupled to both the external and internal cameras 14, 48 and is configured to control operation thereof. The control unit 50 also provides a memory for storage of images captured by the external and internal cameras 14, 48 or an external storage medium 52, such as a hard drive, flash memory, or similar device may be provided for storage of the images. The control unit 50 may be communicatively coupled to the positioning system 16 to obtain position data therefrom and to associate the position data with the images captured by the cameras 14, 48. The control unit 50 might also provide any necessary processing functions of the positioning system 16.

Upon capture of the plurality of images by the 360° external camera 14, the control unit 50 provides processing necessary to generate a composite 360° image 54 as depicted in FIG. 6. The image 54 depicts surroundings in front of the vehicle 10 near the center of the image 54 and surroundings behind the vehicle 10 along the left and right sides of the image 54 while the surroundings to either side of the vehicle 10 are depicted therebetween.

The 360° view provides context for the image 54 and for an asset therein. Features ahead of and behind the vehicle 10 and the asset can be seen. For example, a sign 55F which lies ahead of the vehicle 10 is seen from a front side thereof and a sign 55B which lies behind the vehicle 10 is seen from a back side thereof (FIGS. 5 and 6). This context provides additional assurance that the proper asset has been found and verified during operation of the vehicle 10.

The 360° image 54 can be presented on a monitor 56 associated with the control unit 50 or on a secondary monitor 58 for viewing by operators seated within the vehicle 10. The secondary monitor 58 can be positioned as desired for viewing from any seating position within the vehicle, e.g. from a front seat or a rear seat.

The control unit 50 also displays one or more indicators 60 concurrently with and superimposed or overlaid on the composite 360° image 54. The indicators 60 comprise any visual symbol or feature that is useable to identify a location within the image 54 that corresponds to a physical location alongside the vehicle 10 that is in a desired alignment with the positioning system 16. Preferably, the indicators 60 depict a location that falls on a line 62 that passes through the positioning system 16 and that is perpendicular to a centerline 64 of the vehicle 10. As depicted in FIG. 6, the indicators 60 comprise vertical lines superimposed on the composite 360° image 54 to depict the desired alignment with the positioning system 16 on either side of the vehicle 10, but other forms of indicators 60 might be employed, such as crosshairs, or a highlighted region in the image 54 among other forms.

In one embodiment, the control unit 50 is configured to generate a vertically downward looking, bird's eye view of the area surrounding the vehicle 10. This view can be similarly displayed on one or both of the monitors 56, 58 with the indicators 60 and may aid identifying and aligning the positioning system 16 with low-lying objects like grade crossings.

With continued reference to FIGS. 1-7, operation of the track-data verification vehicle 10 to verify positional data in a PTC track data file for an asset, such as a signal 66 is described in accordance with an embodiment of the invention. The operation of the track-data verification vehicle 10 is described herein with reference to verification of PTC track data but the vehicle 10 and the method of use thereof described herein can be employed to verify positional data based on other track data systems. The vehicle 10 might also be employed for verification of non-railroad based positional data.

Initially, the vehicle 10 is positioned on the rails 12 of a segment of a rail system for which the PTC track data for a plurality of assets is to be verified. An operator/driver of the vehicle 10 is positioned in a driver's seat 68 while a second operator is positioned in a right- or left-side rear seat 70, 72 within reach of the keypad 38 associated with the PTC data-verification unit 30. In one embodiment, only the operator/driver is required to operate the vehicle 10 for verification of the track data; the PTC data-verification unit 30 is positioned to enable viewing of the screen 36 and access to the keypad 38 by the operator/driver from the driver's seat 68.

The PTC data-verification unit 30 is initiated to execute a PTC track-data verification application. The screen 36 is thus displayed on the display device 30 for viewing by the second operator. The control unit 50 is also initiated to activate the external and internal cameras 14, 48. The 360° image 54 captured by the external camera 14 is displayed by the control unit 50 on the monitor 56 or on the secondary monitor 58 for viewing by the operator/driver and/or the second operator. The image 54 comprises a video and can be stored by the control unit 50 in whole. Or only select portions of the video image 54, such as portions within a predetermined distance or temporal window around an asset being verified might be stored. Alternatively, only one or more still images 54 might be stored.

The internal camera 48 captures an image 74 of the display device 34 and the keypad 38. The image 74 can be stored in whole or in part similarly to that of the 360° image 54.

The vehicle 10 is driven along the rails 12 to an asset, the position of which is to be verified. For example, as depicted in FIGS. 5 and 6, the vehicle is driven to the location of a signal 66. The indicators 60 in the 360° image 54 are employed to guide movement of the vehicle 10 to align the signal 66 with the line 62 extending from the positioning system 16 perpendicularly to the vehicle centerline 64. As shown in FIGS. 5 and 6, the vehicle 10 has moved past proper alignment with the signal 66.

Upon attaining alignment of the signal 66 with the indicator 60, the second operator provides an appropriate input to the keypad 38 to indicate the location associated with the signal 66 to the PTC track data-verification unit 30. The internal camera 48 captures an image or video of the screen 36 and of the operator's hand 76 providing the input to the keypad 38, as depicted in FIG. 7. The actual physical or geographic location of the positioning system 16 can be continuously recorded throughout the operation of the vehicle 10 or the geographic location might only be recorded upon receiving the input from the second operator to the keypad 38. The vehicle 10 can then be driven to the next asset to be verified.

The location of the signal 66 or other assets that are verified using the unit 10 are described as the location associated with the asset because the indicated location may not be the actual location of the asset. The asset is typically located a distance transversely away from the positioning system 16 and the rails 12. The verified location is thus the location of the asset relative to the length of the rails 12, e.g. the location at which a line drawn to the asset from the rails 12 is perpendicular to the length of the rails 12. In another embodiment, a transverse distance from the rails 12 to the asset may be measured or estimated by one of the operators or by an application executing on the computing unit 32 to provide a more exact location of the asset.

The 360° image 54 captured by the external camera 16 may optionally be superimposed or overlaid on the image 74 captured by the internal camera 48 to provide a combined image 78 (FIG. 7). The combined image 78 thus provides an image of the signal 66 or other asset being verified, an indication of the alignment of the signal 66 with the positioning system 16, a view of pre-recorded PTC track data for the signal 66, and a visual record of the operator's inputs to the PTC data-verification unit 30. The combined image 78 and/or each of the images 54, 74 separately are thus useable by an auditor to validate that the PTC track data was properly verified by the operators of the vehicle 10. The auditor therefor need not be present in the vehicle 10 or at the time the verification process is carried out in order to provide validation of the verification process. In one embodiment, one or more of the images 54, 74, 78 and/or other data associated the PTC data-verification unit 30 can be transmitted or streamed to a disparate computing system to allow the auditor to monitor and validate the verification process remotely from another location.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A track-data verification vehicle configured for travel on rails of a railroad rail system comprising:

a positive train control (PTC) data-verification unit configured to enable verification of a pre-recorded geographic location of an asset with an actual physical location associated with the asset, the PTC data-verification unit including a visual display of data associated with the asset and an input device;

a positioning system associated with the vehicle and in communication with the PTC data-verification unit;

a first camera mounted in association with the vehicle and in a known spatial offset relative to the positioning system, the first camera capturing an image of the asset;

a display device disposed interior to the vehicle and in communication with the first camera, the display device presenting the image of the asset and displaying an indicator in the image, the indicator indicating a position in the image at which the asset is properly aligned with the positioning system; and an input-capture system that records the provision of inputs provided to the PTC data-verification unit.

2. The track-data verification vehicle of claim 1, wherein the first camera is a 360° camera.

3. The track-data verification vehicle of claim 1, wherein the first camera is an array of cameras.

4. The track-data verification vehicle of claim 1, wherein the asset is properly aligned with the positioning system when a line between the positioning system and the asset is substantially perpendicular to a longitudinal centerline of the vehicle.

5. The track-data verification vehicle of claim 1, wherein the PTC data-verification unit is a train management control system that executes a PTC application for verification of PTC data for the asset.

6. The track-data verification vehicle of claim 1, wherein the input-capture system includes an interface to the PTC data-verification unit that enables recording of inputs provided to the PTC data-verification unit via the input device and of the data associated with the asset presented on the visual display concurrently with the provision of the inputs.

7. The track-data verification vehicle of claim 1, wherein the input-capture system comprises a second camera positioned to capture an image of the visual display and the input device of the train management control system.

8. The track-data verification vehicle of claim 7, wherein the second camera captures an image of an operator providing an input to the input device.

9. The track-data verification vehicle of claim 1, wherein the image captured by the first camera is overlaid on a display produced by the input-capture system depicting the provision of the inputs provided to the PTC data-verification unit to produce a composite image, and wherein the composite image is useable to audit a track-data verification process carried out by operators using the vehicle.

10. The track-data verification vehicle of claim 1, wherein the image captured by the first camera and a display produced by the input-capture system depicting the provision of the inputs provided to the PTC data-verification unit are useable by a Federal Railroad Administration representative to audit a track-data verification process without the representative being physically present in the vehicle.

11. The track-data verification vehicle of claim 1, wherein the positioning system comprises a global positioning system (GPS) and the actual physical location associated with the asset comprises GPS coordinates of the actual physical location.

12. The track-data verification vehicle of claim 1, wherein the first camera is mounted substantially in vertical alignment with the positioning system.

13. A method for generating a record of a track-data verification process that enables auditing of the verification process by an auditor at a subsequent time and without the auditor being physically present for the verification process, the method comprising:

providing a vehicle configured for travel on rails of a rail system to be audited;

capturing, by a first camera, a first image of an asset, the pre-recorded location of which is to be verified;

displaying the image of the asset and an indicator in the image that depicts a desired alignment of the asset with a positioning system associated with the vehicle;

aligning the asset in the image with the indicator;

recording a physical location associated with the asset when aligned with the indicator by providing an input to a positive train control (PTC) data-verification unit; and capturing, by an input-capture system a record of the provision of inputs provided to the PTC verification unit.

14. The method of claim 13, wherein the input-capture system includes a second camera that captures a second image of a visual display and an input device associated with the PTC data-verification unit, the second image depicting an operator providing the input to the PTC data-verification unit.

15. The method of claim 14, further comprising:

generating a composite image that includes the first image overlaid on at least a portion of the second image.

16. The method of claim 13, further comprising:

auditing the track data verification process by viewing the first image and data recorded by the input capture system.

17. The method of claim 13, wherein the first image, data recorded by the input-capture system, data provided by the positioning system, and data provided by the PTC data-verification unit are synchronized relative to one another.

18. The method of claim 13, wherein the indicator displayed in the first image indicates a position that is on a line extending from the positioning system and perpendicular to a longitudinal centerline of the vehicle.

19. The method of claim 13, wherein the first camera is mounted substantially in vertical alignment with the positioning system.

20. An image of a track-data verification process for validating positive train control (PTC) data, the image useable by an auditor to audit the process at a time subsequent to the process and without the auditor being physically present during the process, the image comprising:

a first portion including a view of a display screen associated with a track-data verification unit and of an input device associated with the track-data verification unit, the first portion depicting an operator's interaction with the input device, the first portion being captured by a first camera mounted interior to a track-data verification vehicle; and a second portion that includes a view of an asset, the PTC data for which is to be verified by the process, the second portion further including an indicator disposed therein that depicts a position at which the asset is in a desired alignment with a positioning system used in the process, the second portion being captured by a second camera mounted on top of the vehicle and in a known spatial relationship to the positioning system.

* * * * *